United States Patent [19]

Rollmann

[11] 4,263,126

[45] Apr. 21, 1981

[54] PREPARATION AND USE OF REACTIVE DISPERSIONS

[75] Inventor: Louis D. Rollmann, Princeton, N.J.

[73] Assignee: Mobil Oil Corporation, Fairfax, Va.

[21] Appl. No.: 86,892

[22] Filed: Oct. 22, 1979

[51] Int. Cl.[3] ..... C10G 11/05; C10G 47/16

[52] U.S. Cl. ..... 208/14; 208/111; 208/120; 208/157; 208/370; 252/455 Z

[58] Field of Search ..... 208/111, 120, DIG. 2; 252/455 Z

[56] References Cited

U.S. PATENT DOCUMENTS

| | | | |
|---|---|---|---|
| Re. 28,398 | 4/1975 | Chen et al. | 208/111 |
| Re. 29,948 | 3/1979 | Dwyer et al. | 208/110 |
| 3,129,164 | 4/1964 | Cameron | 208/8 |
| 3,668,113 | 6/1972 | Burbidge et al. | 208/97 |
| 3,702,886 | 11/1972 | Argauer et al. | 208/111 |
| 3,709,979 | 1/1973 | Chu | 423/329 |
| 3,832,449 | 8/1974 | Rosinski et al. | 423/328 |
| 4,016,245 | 4/1977 | Plank et al. | 423/328 |
| 4,046,859 | 9/1977 | Plank et al. | 423/328 |
| 4,076,842 | 2/1978 | Plank et al. | 423/328 |

*Primary Examiner*—Herbert Levine
*Assistant Examiner*—G. E. Schmitkons
*Attorney, Agent, or Firm*—C. A. Huggett; V. J. Frilette

[57] ABSTRACT

This invention provides a method for converting waxy or viscous hydrocarbon oils to lower pour point or less viscous oils. By this method, reactive dispersions of zeolites, such as HZSM-5 crystals, are prepared with the oil to be converted, and conversion is effected by heating the dispersion.

23 Claims, 1 Drawing Figure

POUR POINT vs. ZSM-5 CONTENT, TACHING CRUDE DISPERSIONS

PREPARATION AND USE OF REACTIVE DISPERSIONS

BACKGROUND OF THE INVENTION

1. Field of the Invention

This invention is concerned with a dispersion of fine zeolite particles exemplified by ZSM-5 and ZSM-11 crystals in a hydrocarbon oil. It is more particularly concerned with a reactive dispersion of such particles in a hydrocarbon oil such as, for example, a waxy virgin crude oil. It is further concerned with a process for upgrading a waxy or excessively viscous hydrocarbon oil by forming a reactive dispersion of such with fine particles of zeolite and heating the same. The process of this invention results in reduction of the pour point, or of the viscosity, or of both, of the heavy oil.

2. Prior Art

The use of zeolite catalysts based on rare-earth exchanged zeolites X and Y has become widely accepted by the petroleum industry for cracking gas oil to make gasoline and fuel oil. More recently, other petroleum and petrochemical processes which utilize zeolite catalysts have been proposed. U.S. Reissue Pat. No. 28,398 to Chen et al describes the dewaxing of oils by shape selective cracking and hydrocracking catalyzed by zeolites of the ZSM-5 type, and includes examples to pour point reduction of a shale oil, a lube base stock and a gas oil. U.S. Pat No. 3,668,113 to Burbidge et al describes the dewaxing of a heavy gas oil by contact in the presence of hydrogen with a crystalline mordenite containing a hydrogenation component. Many other patents have issued which describe the treatment of particular feedstocks or a particular manner of treating a feedstock. To the best of applicant's knowledge and belief, however, all known or proposed processes which involve zeolite catalyzed hydrocarbon reactions utilize a fixed bed reactor with particles no smaller than 1/25th of an inch diameter, or a fluidized bed of catalyst, as in catalytic cracking, wherein the particle size ranges from about 1 to 140 microns with an average particle size about 62 microns, and in all of these processes the reaction is conducted with a relatively large amount of catalyst in contact with the feed at any given instant. Even a flooded trickle bed reactor, for example, will have more than about 40 parts by weight of catalyst in contact with 100 parts of oil at any given instant.

BRIEF SUMMARY OF THE INVENTION

It has now been found that a reactive dispersion is formed by mixing a convertible hydrocarbon oil with from about 0.02 up to about 10 wt.% of the oil of fine zeolite particles exemplified by ZSM-5 crystals, as more fully described hereinbelow. If the convertible hydrocarbon oil is a waxy oil of undesirably high pour point and the conversion desired is reduction of the pour point, the amount of fine particles for the purpose of this invention is alternatively described as that amount within the above recited range which is effective for reducing the pour point of the hydrocarbon oil by at least about 10° C. when the dispersion is heated to a temperature of about 200° to about 500° C. for a period of about 0.1 hour to 72 hours.

As will be shown below, as little as 1 wt.% of fine zeolite particles, or even 0.2 wt.%, is often sufficient to produce a ractive dispersion which, on heating for as little as 3 hours, will react with drastic lowering of the pour point. This is a unexpected result in view of the relatively large amounts of catalyst involved in conventional dewaxing conversion.

By the process of this invention, which involves preparing and heating the reactive dispersion as more fully described hereinbelow, crude oils too waxy to pipeline at low cost or at all may be converted to low pour point crudes at the wellhead; and very viscous crudes may be advantageously upgraded to lower viscosity oils. Petroleum distillates such as waxy gas oils may be used to form the reactive dispersion of this invention and dewaxed advantageously by the process of this invention. Other uses for the reactive dispersion of this invention will be evident to those skilled in the art.

DETAILED DESCRIPTION OF THE INVENTION

Figure 1:
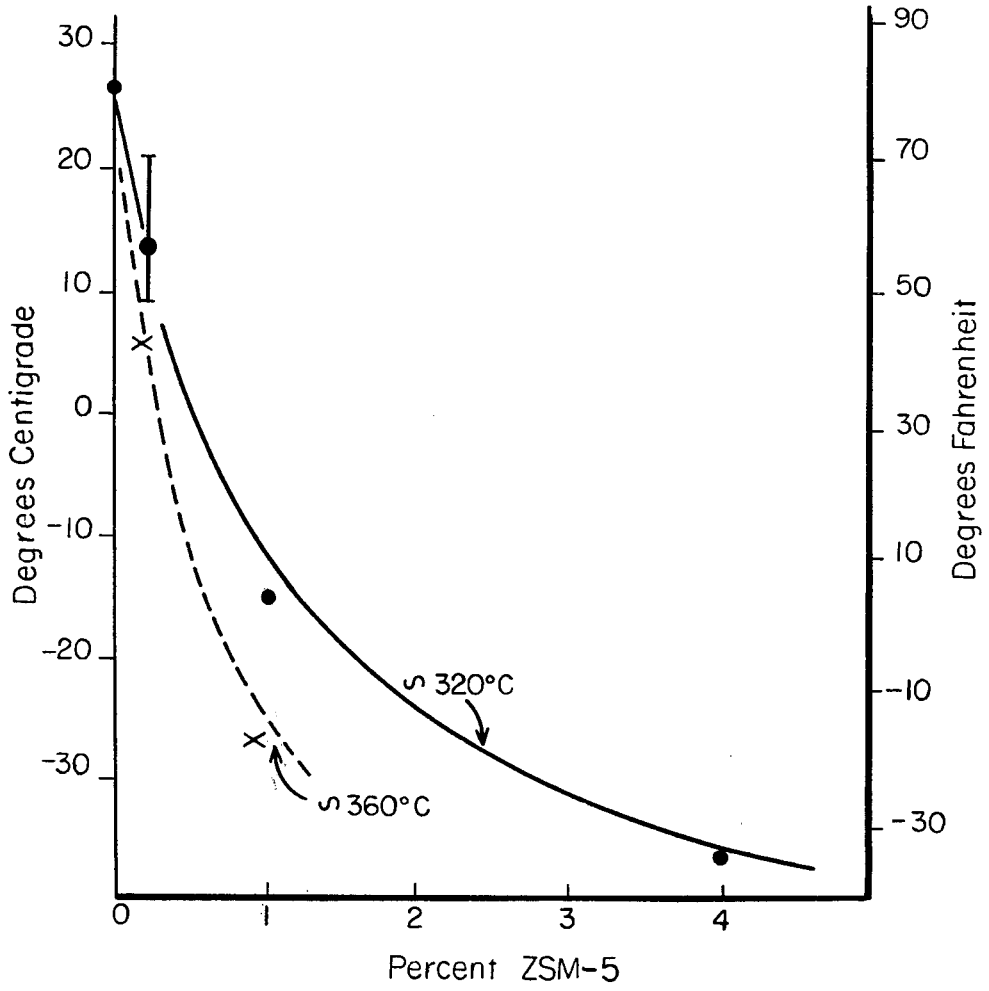
FIG. 1: Pour point reduction of Taching Crude

The fine zeolite particles herein referred to include synthetic zeolite crystals which, as synthesized, may have a particle size as small as less than about 0.01 micron but in some instances may range up to about 5 microns or larger. It is known that the particle size produced in zeolite manufacture in general falls within this recited range, and that the particular particle size obtained depends to some extent on which zeolite is produced, and to some extent on the recipe used to produce it. In any case, zeolite crystals having crystallites in the size range of from less than about 0.01 micron to about 5 microns are of suitable size for preparing the reactive dispersions of the invention.

As will be evident from this entire description, the term "zeolite" as used herein refers to an inorganic cryptocrystalline powder with a composition consisting predominantly of silica, usually but not necessarily associated with some alumina, and exhibiting a well-defined X-ray diffraction pattern characteristic of the zeolitic crystal structure. For purposes of this invention, the term "zeolite" excludes amorphous compositions of silica and alumina which have no zeolitic structure.

The zeolites utilized herein which are particularly effective in this invention are members of a novel class of zeolites that exhibits unusual properties. Although these crystalline zeolites have unusually high silica to alumina ratios, they are very active as conventional catalysts even when the silica to alumina ratio exceeds 30. The activity is surprising since catalytic activity is generally attributed to framework aluminum atoms and/or cations associated with these aluminum atoms. These zeolites retain their crystallinity for long periods in spite of the presence of steam at high temperature which induces irreversible collapse of the framework of other zeolites, e.g. of the X and A type. Furthermore, carbonaceous deposits, when formed, may be removed by burning at higher than usual temperatures to restore activity. These zeolites, used as conventional catalysts, generally have low coke-forming activity and therefore are conducive to long times on stream between regenerations by burning with oxygen-containing gas such as air.

An important characteristic of the crystal structure of this class of zeolites is that it provides constrained access to and egress from the intracrystalline free space by virtue of having an effective pore size intermediate between the small pore Linde A and the large pore Linde X, i.e. the pore windows of the structure have about a size such as would be provided by 10-membered rings of oxygen atoms. It is to be understood, of course, that these rings are those formed by the regular disposition of the tetrahedra making up the anionic framework of the crystalline aluminosilicate, the oxygen atoms themselves being bonded to the silicon or aluminum atoms at the centers of the tetrahedra. Briefly, the preferred type zeolites useful in this invention possess, in combination: a silica to alumina mole ratio of at least about 12; and a structure providing constrained access to the crystalline free space.

The silica to alumina ratio referred to often may be determined by conventional analysis. This ratio is meant to represent, as closely as possible, the ratio in the rigid anionic framework of the zeolite crystal and to exclude aluminum or in cationic or other form within the channels. Although zeolites with a silica to alumina ratio of at least 12 are useful, it is preferred to use zeolites having higher ratios of at least about 30. Such zeolites, after activation, acquire an intracrystalline sorption capacity for normal hexane which is greater than that for water, i.e. they exhibit "hydrophobic" properties. It is believed that this hydrophobic character is advantageous in the present invention.

The zeolites of this novel class, particularly efficient in this invention, have an effective pore size such as to freely sorb normal hexane. In addition, the structure must provide constrained access to larger molecules. It is sometimes possible to judge from a known crystal structure whether such constrained access exists. For example if the only pore windows in a crystal are formed by 8-membered rings of oxygen atoms, then access by molecules of larger cross-section than normal hexane is excluded and the zeolite is not of the most effective type. Windows of 10-membered rings are preferred, although in some instances excessive puckering of the rings or pore blockage may render these zeolites ineffective. 12-membered rings usually do not offer sufficient constraint to produce the advantageous conversions, with good selectivity, although the puckered 12-ring structure of TMA offretite shows constrained access. Other 12-ring structures may exist which, due to pore blockage or to other cause, may be operative.

Rather than attempt to judge from crystal structure whether or not a zeolite possesses the effective constrained access to molecules larger than normal paraffins, a simple determination of the "Constraint Index" as herein defined may be made by passing continuously a mixture of an equal weight of normal hexane and 3-methylpentane over a small sample, approximately one gram or less, of zeolite at atmospheric pressure according to the following procedure. A sample of the zeolite, in the form of pellets or extrudate, is crushed to a particle size about that of coarse sand and mounted in a glass tube. Prior to testing, the zeolite is treated with a stream of air at 1000° F. for at least 15 minutes. The zeolite is then flushed with helium and the temperature is adjusted between 550° F. and 950° F. to give an overall conversion between 10% and 60%. The mixture of hydrocarbons is passed at 1 liquid hourly space velocity (i.e., 1 volume of liquid hydrocarbon per volume of zeolite per hour) over the zeolite with a helium dilution to give a helium to total hydrocarbon mole ratio of 4:1. After 20 minutes on stream, a sample of the effluent is taken and analyzed, most conveniently by gas chromatography, to determine the fraction remaining unchanged for each of the two hydrocarbons.

The "Constraint Index" is calculated as follows:

$$\text{Constraint Index} = \frac{\log_{10}(\text{fraction of n-hexane remaining})}{\log_{10}(\text{fraction of 3-methylpentane remaining})}$$

The Constraint Index approximates the ratio of the cracking rate constants for the two hydrocarbons. Zeolites most effective for the present invention are those having a Constraint Index of 1 to 12. Constraint Index (CI) values of zeolites, including some which are not of the particularly effective group, are:

| CAS | C.I. |
|---|---|
| ZSM-4 | 0.5 |
| ZSM-5 | 8.3 |
| ZSM-11 | 8.7 |
| ZSM-12 | 2 |
| ZSM-23 | 9.1 |
| ZSM-35 | 4.5 |
| ZSM-38 | 2 |
| TMA Offretite | 3.7 |
| Beta | 0.6 |
| H-Zeolon (mordenite) | 0.4 |
| REY | 0.4 |
| Amorphous Silica-Alumina | 0.6 |
| Erionite | 38 |

The above-described Constraint Index is contemplated as an important criterion for selecting those zeolites which are most efficient in the instant invention. The very nature of this parameter and the recited technique by which it is determined, however, admit of the possibility that a given zeolite can be tested under somewhat different conditions and thereby have different Constraint Indexes. Constraint Index seems to vary somewhat with severity of operation (conversion) and the presence or absence of binders. Therefore, it will be appreciated that it may be possible to so select test conditions to establish more than one value in the range of 1 to 12 for the Constraint Index of a particular zeolite. Such a zeolite exhibits the constrained access as herein defined and is to be regarded as having a Constraint Index of 1 to 12. Also contemplated herein as having a Constraint Index of 1 to 12 and therefore within the scope of the novel class of highly siliceous zeolites are those zeolites which, when tested under two or more sets of conditions within the above-specified ranges of temperature and conversion, produce a value of the Constraint Index slightly less than 1, e.g. 0.9, or somewhat greater than 12, e.g. 14 or 15, with at least one other value of 1 to 12. That is, a zeolite when tested by any combination of conditions within the testing definition set forth hereinabove to have a Constraint Index of 1 to 12 is intended to be included in the instant catalyst definition regardless that the same identical zeolite tested under other defined conditions may give a Constraint Index value outside of 1 to 12.

The class of zeolites defined herein is exemplified by ZSM-5, ZSM-11, ZSM-12, ZSM-23, ZSM-35, ZSM-38, and other similar materials. U.S. Pat. No. 3,702,886 describing and claiming ZSM-5 is incorporated herein by reference.

ZSM-11 is more particularly described in U.S. Pat. No. 3,709,979, the entire content of which is incorporated herein by reference.

ZSM-12 is more particularly described in U.S. Pat. No. 3,832,449, the entire content of which is incorporated herein by reference.

ZSM-23 is more particularly described in U.S. Pat. No. 4,076,842, the entire content of which is incorporated herein by reference.

ZSM-35 is more particularly described in U.S. Pat. No. 4,016,245, the entire content of which is incorporated herein by reference.

ZSM-38 is more particularly described in U.S. Pat. No. 4,046,859, the entire content of which is incorporated herein by reference.

ZSM-5 made essentially without alumina is described in Re. No. 29,948 reissued Mar. 27, 1979. The entire content of this patent is incorporated herein by reference, noting that the X-ray diffraction pattern is substantially identical to ZSM-5 as shown in U.S. Pat. No. 3,702,886.

Crystalline zeolites of the most effective type may in some instances be made with essentially no alumina content. In such cases the "Constraint Index" may be difficult to directly determine by the above-described procedure. It is intended in such instances to rely on X-ray diffraction pattern as a primary indication of inclusion within the most effective class, subject to confirmation by measurement of sorption capacity for n-hexane and relative rates of sorption for n-hexane, 3-methylpentane and exclusion of 2,2-dimethylbutane. These substantially alumina-free homologs are believed useful for conversions of the "dewaxing" type, and may be ineffective for other contemplated conversions such as benzene alkylation.

The specific zeolites described, when prepared in the presence of organic cations, are substantially catalytically inactive, possibly because the intracrystalline free space is occupied by organic cations from the forming solution. They may be activated by heating in an inert atmosphere at 1000° F. for one hour, for example, usually followed by base exchange with ammonium salts followed by calcination at 1000° F. in air. The presence of organic cations in the forming solution may not be absolutely essential to the formation of this type zeolite; however, the presence of these cations does appear to favor the formation of this special class of zeolite. More generally, it is desirable to activate this type catalyst by base exchange with ammonium salts followed by calcination in air at about 1000° F. for from about 15 minutes to about 24 hours. Low sodium content zeolites such as described in U.S. Pat. No. 4,151,189 are effectively activated by this procedure.

It is contemplated that natural zeolites may sometimes be transformed to highly effective zeolites by treatments such as base exchange, steaming, alumina extraction and calcination, in combinations. Natural minerals which may be so treated include ferrierite, erionite, brewsterite, stilbite, dachiardite, epistilbite, heulandite, and clinoptilolite. The preferred crystalline zeolites are ZSM-5, ZSM-11, ZSM-12, ZSM-23, ZSM-35, and ZSM-38, with ZSM-5 and ZSM-11 being particularly preferred.

In a preferred aspect of this invention, the particularly effective zeolites hereof are selected as those having a crystal framework density, in the dry hydrogen form, of not less than about 1.6 grams per cubic centimeter. It has been found that zeolites which satisfy all three of these criteria are most desired for several reasons. When hydrocarbon products or by-products are catalytically formed, for example, such zeolites tend to maximize the production of gasoline boiling range hydrocarbon products. Therefore, the preferred zeolites of this invention are those having a Constraint Index as defined above of about 1 to about 12, a silica to alumina ratio of at least about 12 to a dried crystal density of not less than about 1.6 grams per cubic centimeter. The dry density for known structures may be calculated from the number of silicon plus aluminum atoms per 1000 cubic Angstroms, as given, e.g., on Page 19 of the article on Zeolite Structure by W. M. Meier. This paper, the entire contents of which are incorporated herein by reference, is included in "Proceedings of the Conference on Molecular Sieves, London, April 1967," published by the Society of Chemical Industry, London, 1968. When the crystal structure is unknown, the crystal framework density may be determined by classical pyknometer techniques. For example, it may be determined by immersing the dry hydrogen form of the zeolite in an organic solvent which is not sorbed by the crystal. Or, the crystal density may be determined by mercury porosimetry, since mercury will fill the interstices between crystals but will not penetrate the intracrystalline free space. It is possible that the unusual and unexpected effectiveness of this class of zeolites is associated with its high crystal anionic framework density of not less than about 1.6 grams per cubic centimeter. This high density must necessarily be associated with a relatively small amount of free space within the crystal, which might be expected to result in more stable structures. This free space, however, is important as the locus of catalytic activity.

Crystal framework densities of some typical zeolites, including some which are not within the purview of the particularly effective group, are:

| Zeolite | Void Volume | Framework Density |
|---|---|---|
| Ferrierite | 0.28 cc/cc | 1.76 g/cc |
| Mordenite | .28 | 1.7 |
| ZSM-5, -11 | .29 | 1.79 |
| ZSM-12 | — | 1.8 |
| ZSM-23 | — | 2.0 |
| Dachiardite | .32 | 1.72 |
| L | .32 | 1.61 |
| Clinoptilolite | .34 | 1.71 |
| Laumontite | .34 | 1.77 |
| ZSM-4 (Omega) | .38 | 1.65 |
| Heulandite | .39 | 1.69 |
| P | .41 | 1.57 |
| Offretite | .40 | 1.55 |
| Levynite | .40 | 1.54 |
| Erionite | .35 | 1.51 |
| Gmelinite | .44 | 1.46 |
| Chabazite | .47 | 1.45 |
| A | .5 | 1.3 |
| Y | .48 | 1.27 |

When synthesized in the alkali metal form, the zeolite may beconverted to the hydrogen form, generally by intermediate formation of the ammonium form as a result of ammonium ion exchange and calcination of the ammonium form to yield the hydrogen form. In addition to the hydrogen form, other forms of the zeolite wherein the original alkali metal has been reduced to less than about 1.5 percent by weight, or replaced by ion exchange with other suitable metal cations of Groups I through VIII of the Periodic Table, may be used. Nickel, copper, zinc, palladium, calcium or rare earth metals are contemplated, for example.

The particularly effective zeolites described above may be used in the particle size as crystallized, i.e. in unconsolidated form, which is an extremely fine powder having a particle size from less than about 0.01 to about 5 microns. In fact, it is preferred to use the as-formed powder since this is convenient and least expensive if no separation or reuse of the particles is required. However, when the process of this invention includes separation of the particles from the converted oil, this separation is facilitated by incorporating the zeolite in a matrix and forming particles in the particle size range of about 10 to about 250 microns. In any case, regardless of whether crystals free of matrix or particles comprising matrix is used, it is to be understood that the crystals are to be in catalytically active form before the particles are suitable for use in this invention. A suitable activation procedure for catalytically inactive crystals, including calcination at 1000° F., is described above.

Suitable matrix materials include synthetic or naturally occurring substances as well as inorganic materials such as clay, silica and/or metal oxides. The latter may be either naturally occurring or in the form of gelatinous precipitates or gels including mixtures of silica and metal oxides. Naturally occurring clays which can be montmorillonite and kaolin families, which families include the sub-bentonites and the kaolins commonly known as Dixie, McNamee-Georgia and Florida clays or others in which the main mineral constituent is halloysite, kaolinite, dickite, nacrite or anauxite. Such clays can be used in the raw state as originally mined or initially subjected to calcination, acid treatment or chemical modification.

In addition to the foregoing materials, the zeolites employed herein may be composited with a porous matrix material, such as alumina, silica-alumina, silica-magnesia, silica-zirconia, silica-thoria, silica-berylia, silica-titania as well as ternary compositions, such as silica-alumina-thoria, silica-alumina-zirconia, silica-alumina-magnesia and silica-magnesia-zirconia. The matrix may be in the form of a cogel. The relative proportions of zeolite component and inorganic oxide gel matrix on an anhydrous basis may vary widely with the zeolite content ranging from between about 1 to about 99 percent by weight and more usually in the range of about 5 to about 80 percent by weight of the dry composite.

A variety of hydrocarbon oils may be used to prepare the reactive dispersion of this invention. One group of such oils is that which contains sufficient waxes to impart an undesirably high pour point. In general, such oils have a substantial fraction, i.e. at least about 10 vol.%, which distils above 350° F. These oils, as a group, will be referred to herein as "waxy" oils, and include virgin petroleum crudes and fractions thereof such as kerosene, jet fuel, light gas oil, heavy gas oil, fuel oils, and atmospheric and vacuum tower residua. Lube base stock oils also are included. Shale oil, oil from tar sands, waxy hydrocracked oils, and waxy syncrudes derived from coal are included. All of the foregoing waxy oils are convertible to lower pour point upgraded oils and suitable for preparing the reactive dispersions of this invention. It is to be understood that the phrase "undesirably high pour point" refers to no fixed temperature, since what is undesirable depends on the local climate and the particular used intended for the oil.

Another group of hydrocarbon oils, herein referred to as "viscous oils", is characterized by a low wax content but a viscosity sufficiently high at ambient temperatures to preclude economical handling. This group is illustrated by certain viscous naphthenic crude oils and atmospheric or vacuum tower residual oils derived from naphthenic or low wax content crudes. Oils with a viscosity in excess of about 850 centistokes at 38° C. generally could be troublesome or costly to transfer or transport. Such viscous oils are convertible to lower viscosity oils and suitable for preparing reactive dispersions.

It is an unexpected and advantageous aspect of the present invention that the above-described reactive dispersions may be prepared with virgin crude oils and other oils heavily contaminated by impurities such as water, heteroatom compounds like sulfur-, nitrogen-, and oxygen-containing compounds, metal porphyrins, asphaltenes and salt, without the necessity for removing at least a portion of these. Without being bound by theory, it is believed that the conversion observed on heating the reactive dispersion as described herein is a catalytic effect dependent on the presence of the dispersed particles. In ordinary catalysis, however, nitrogen compounds are commonly regarded as catalyst deactivators (poisons) for hydrocarbon conversions, and asphaltenes as coke-formers which also reduce catalytic activity. Nonetheless, it will be recognized by those skilled in the art from the examples described below that substantial conversion is achieved by heating the reactive dispersion.

As will be further illustrated below by example, the reactive dispersions of this invention may be prepared simply by mixing the fine zeolite particles, preferably the activated crystals, with the convertible hydrocarbon oil in the desired proportions. In some cases it will be desirable to heat the mixture to promote dispersion. And, although it is a feature of this invention that reactive dispersions may be prepared by simple mechanical mixing, it is contemplated as within the scope of this invention to augment the reactivity of the dispersion by adjuvant means such as the addition of a dispersing agent or the use of a mechanical mill such as a colloid mill whereby a concentrate of well-dispersed crystals is prepared. This concentrate may be advantageously used to prepare the reactive dispersion.

The process of this invention comprises making the reactive dispersion described above and heating it to a temperature of about 200° C. to 500° C. for a time effective to induce conversion, usually from 0.1 to 72 hours. Forming the dispersion and heating may be done substantially simultaneously by adding the catalytic material to the heated oil.

The heating is conveniently conducted in a closed vessel in the absence of added hydrogen and under autogenous pressure which increases during the heating period. Stirring may be used to promote uniformity of the dispersion and advance the conversion. Alternatively, hydrogen pressure may be applied during the heating period so as to induce the conversion in the presence of hydrogen. In any case, the process of this invention operates in the liquid phase, and a major fraction of the reactive dispersion is maintained in the liquid phase during conversion. It is sometimes desirable, however, to remove volatiles formed on heating and during conversion from the reaction vessel and thereby recover light gases and liquid simultaneously with conversion.

In many cases the solid particles need not be separated from the converted dispersion and will not interfere with subsequent processing and use, particularly if the solid partilces are extremely fine as they are in the zeolite crystals. In some instances, however, such particles agglomerate in which case the agglomerates may be separated by decantation or by screens. When it is desired to separate the solid particles, however, it is preferred to use larger size particles than as-formed crystals, such as particles in the size range of 10 to 250 microns, and these may be separated by screens, centrifugation, sedimentation, or other means known in the art.

The process of this invention is particularly suited to reducing the pour point of waxy hydrocarbon oils such as waxy crudes or waxy distillates. It is also suited to reducing the viscosity of very viscous hydrocarbon oils. When applied to dewaxing or viscosity reduction, the process of this invention produces by-product gases and liquids in amount depending on the feed, extent of conversion and particular zeolite used. In all cases, the amount of by-product hydrocarbon gases, i.e. the $C_3$ and $C_4$ hydrocarbons, from the reactive dispersion exceeds the amount produced when the same amount of hydrocarbon oil alone is heated at the same temperature and for the same length of time as the reactive dispersion.

Although it is a feature of this invention that the reactive dispersions may be converted under autogenous pressure or at constant autogenous pressure and in the absence of added hydrogen, it is contemplated as within the scope of this invention to conduct the conversion under hydrogen pressure at a partial pressure of hydrogen of 100 psig to 2000 psig.

This invention has been described with extensive reference to what applicant believes to be the particularly effective zeolites for the purpose of this invention. More specifically, zeolites having the above prescribed silica to alumina ratio and Constraint Index, and most especially ZSM-5 and ZSM-11, are believed to be particularly effective in producing the desired extent of pour point reduction, for example, with low concentrations of zeolite in the reactive dispersion. Nonetheless, other zeolites are also useful. As will be illustrated by example, hydrogen Y and mordenite are effective. Hydrogen Y partially in the rare earth exchanged form may be used. Thus, for purposes of this invention, it is contemplated broadly to prepare the reactive dispersions of this invention and conduct the process of this invention utilizing a crystalline zeolite having a pore size of at least 5 Angstroms and a normal hexane sorption capacity of at least about 5 wt.% when exposed at 25° C. to 20 mm vapor pressure of normal hexane.

This invention will now be illustrated by examples, which are not to be interpreted as restricting the scope thereof, said scope being defined by this entire specification including the appended claims.

EXAMPLES

EXAMPLE 1

Virgin Taching whole crude was used in this experiment. According to Shell Assay 1974 Doc. No. 8974, this crude typically has the following composition and properties:

| | |
|---|---|
| Gravity, API | 33.3 |
| Carbon Residue, Pct. Wt. (CCR) | 3.04 |
| Sulfur, Pct. Wt. | 0.095 |
| Water and Sediment, Pct. Vol. | 0.1 |
| Salt Content, pound/1000 B | 1.8 |
| Nickel, ppm | 3.95 |
| Pour point, °F. (upper) | 97 |

An analysis of the Taching crude used in this example gave the following results:

| | |
|---|---|
| Sulfur by XRF | 0.095% |
| Carbon-Micro Pregl | 84.68% |
| Hydrogen-Micro Pregl | 13.24% |
| Basic Nitrogen | 637 ppm |
| Nickel | 3.5 ppm |
| Vanadium | 0.15 ppm |
| Iron | 10 ppm |
| Nitrogen-Micro Dumas | 0.18% |
| IBP-330° F. | 8.5% |
| 330-800° F. | 36% |
| 800 + °F. | 60.5% |
| Pour point | 35° C. (95° F.) |

70 grams of Taching crude and 0.8 grams of HZSM-5 in a fluid catalyst matrix were placed in a stirred autoclave and heated at 350° C. for 2 hours. The fluid catalyst particles contained 35 wt.% ZSM-5 and 65% matrix, and over 75% of the material had a particle size less than 250 microns. The product oil had a pour point of 10° C. as compared with 35° C. for the initial crude and was noticeably less viscous. During the heating, the autoclave pressure increased from 0 psig to 360 psig with the production of 1800 cc of light gas, mainly $C_3$-$C_4$ hydrocarbons.

EXAMPLE 2

For purposes of comparison, 50 grams of the same Taching whole crude as used in Example 1 was placed in the same stirred autoclave and was heated for 3 hours at 335° C. The pressure increased from 0 psig to 275 psig. 2300 cc of gas was produced, mainly hydrogen. The pour point after heating was 26° C.

EXAMPLES 3–9

Each of seven 50 to 66 grams batches of the same Taching crude as used in Example 1 was placed in a stirred autoclave with varying amounts of either HZSM-5 powder or a fluid catalyst containing 40% active ZSM-5. These were heated for times and temperatures shown in Table I. In all cases, a modest to marked reduction of pour point was observed. In all cases the gases were predominantly $C_3$ to $C_4$ hydrocarbons in an amount calculated as less than 4 wt.% of the crude initially charged. The ZSM-5 crystals had an average particle size of 0.02 to 0.03 microns.

TABLE I

| Ex. No. | powder | Wt. % of Oil | Hours | Temp., °C. | Pour Point, °C. |
|---|---|---|---|---|---|
| 3 | HZSM-5 Crystals | 0.2 | 3 | 320 | 9 |
| 4 | HZSM-5 Crystals | 0.2 | 5 | 330 | 21 |
| 5 | HZSM-5 Crystals | 1.0 | 1 | 320 | 14 |
| 6 | HZSM-5 Crystals | 1.0 | 3 | 310 | −17 |
| 7 | Fluid Catalyst | 4.0 | 3 | 320 | −35 |
| 8 | HZSM-5 Crystals | 0.2 | 2.5 | 360 | 7 |
| 9 | HZSM-5 Crystals | 1.0 | 2.0 | 350 | −27 |

These results of Table I are summarized in graphical form in FIG. 1.

EXAMPLE 10

70 grams of the same Taching crude as used in Example 1 was placed in a stirred autoclave and 0.7 grams of 0.02–0.03 micron HZSM-5 crystals added. The mixture was heated with stirring to 350° C. for 2 hours. The gas was periodically vented to maintain a pressure of 100 psig over the dispersion. The vented gas was passed through a trap at 0° C. to condense distilled hydrocarbons. 13.4 grams of hydrocarbons were collected in the trap, representing 19% of the original crude. The converted dispersion remaining in the autoclave had a pour point of −130° C. This product is essentially a dewaxed residuum.

EXAMPLE 11

For this experiment a sample of a viscous Melones-34 crude from Venezuela was used. This was found to have the following properties:

| | |
|---|---|
| Gravity, API | 9.8 |
| IBP (TBP) | 185° F. |
| 5% recovered (TBP) | 508° F. |
| Pour Point (Upper) | 45° F. |
| Kinematic viscosity, 100° F. | 16133 centistokes |
| Sulfur | 3.88 wt. % |
| Water and Sediment | 1.0 vol. % |
| Salt content, lbs/1000 bbl | 14 |
| Nitrogen, total | 5900 ppm |
| Nickel | 88 ppm |
| Vanadium | 349 ppm |

70 grams of this Melones heavy crude and about 1.2 grams of ZSM-5 in a fluid matrix of the same kind as used in Example 1, were placed in a stirred autoclave. The total weight of particles used was 3.4 grams. The dispersion was heated for 2½ hours at 350° C. The pressure increased from 0 psig to 250 psig. 1900 cc of gas was produced, mainly $C_3$ and $C_4$ hydrocarbons. The product was noticeably less viscous than the untreated crude, and the gas contained an odor of $H_2S$.

EXAMPLE 12

90 grams of Nigerian gas oil with a pour point of 23° C. and 0.9 grams of HZSM-5 crystals were placed in a stirred autoclave and heated 2 hours at 350° C. The pressure increased from from 0 psig to 420 psig. 2800 cc of gas was produced. The liquid product was decanted from agglomerated crystals. The decanted oil had a pour point of −31° C.

EXAMPLE 13

Brown colored agglomerated crystals are recovered from the product of Example 12 and heated in air to a dull red heat for a period of less than 5 minutes; a white ash is recovered.

EXAMPLE 14

104 grams of Nigerian gas oil with a pour point of 23° C. and 0.2 grams of HZSM-5 crystals was heated in a stirred autoclave for 3 hours at 360° C. Pressure increased from 0 psig to 180 psig. 500 cc of gas was produced. The converted gas oil had a pour point of +16° C.

EXAMPLE 15

62 grams of the same Taching crude as used in Example 1 was mixed with 0.6 grams of ZSM-35 crystals. The dispersion was heated for 2 hours at 380° C. The pressure increased from 0 psig to 340 psig. 2800 cc of gas was produced. The product liquid had a pour point of +16° C.

EXAMPLE 16

73 grams of the same Taching crude as used in Example 1 was mixed with 0.7 grams of dealuminized mordenite crystals with a silica to alumina ratio of 98 and a crystal size of about 1 micron. The dispersion was heated in a stirred autoclave for 2 hours at 380° C. The pressure increased from 0 psig to 300 psig. 3000 cc of gas were produced. The liquid product had a pour point of +18° C.

EXAMPLE 17

61 grams of the same Taching crude as used in Example 1 and 0.6 grams of HY (hydrogen Y) crystals were heated in a stirred autoclave for 2 hours at 360° C. Pressure increased from 0 psig to 315 psig. 3400 cc of gas were produced. The liquid product had a pour point of +17° C.

The foregoing examples illustrated certain aspects of this invention, particular emphasis being placed on conversion to reduce either pour point or viscosity, or both. Also contemplated as within the scope of this invention are to conduct fractionation and dewaxing simultaneously; to convert a reactive dispersion comprising crude oil or a fraction thereof under conditions effective to reduce the content of non-hydrocarbon constituents such as the sulfur content of the oil. Also contemplated are conversions of hydrocarbon oils such as hydrogenation, dehydrogenation, paraffin isomerization, cracking, and the transmutation, isomerization, and alkylation, of aromatic hydrocarbon oils that contain benzene, toluene or xylenes. In some of the foregoing conversions it is required to conduct the conversion in the presence of hydrogen, and the particles comprising catalytically active zeolite may contain a hydrogenation component such as nickel, platinum, cobalt, molybdenum, tungsten, or a platinum group metal.

In at least some of the foregoing examples, it is believed that converted reactive dispersion is still reactive in the sense that if the heating period is repeated, the pour point, for example, would further decrease due to catalytic conversion. Contemplated as within the scope of this invention, therefore, is a process wherein a reactive dispersion is converted by heating in stages, each stage being either under the same conditions or under different conditions. By a proper combination of such conditions, it is contemplated to form a converted oil that has, for example, a pour point reduced to specification together with an acceptable sulfur content. Thus, as will be recognized by those skilled in the art, the reactive dispersion and process of this invention afford versatile means for converting and upgrading hydrocarbon oils.

What is claimed is:

1. A process for converting a convertible hydrocarbon oil, said process comprising dispersing in said hydrocarbon oil from about 0.02 wt.% to about 10 wt.% of said oil of particles comprising a catalytically active zeolite, said particles having a particle size from less than about 0.01 microns to 250 microns, and said zeolite having a pore size of at least 5 Angstroms and a normal hexane sorption capacity of at least 5 wt.% when exposed at 25° C. to 20 mm vapor pressure of normal hexane, and heating said dispersion at a temperature of about 200° to about 500° C. for from 0.1 to 72 hours to effect said conversion.

2. The process described in claim 1 including the step of separating said particles from said converted oil.

3. The process described in claim 1 wherein said zeolite has a silica to alumina ratio of at least about 12 and a Constraint Index of 1 to 12.

4. The process described in claim 3 wherein said zeolite is ZSM-5 or ZSM-11.

5. The process described in claim 4 wherein said particle size is from less than about 0.01 microns to about 5 microns.

6. The process described in claim 1 wherein said convertible hydrocarbon oil is a waxy oil at least 25% of which distils above 350° F. and said conversion reduces the pour point of said oil.

7. The process described in claim 6 including the step of separating said particles from said converted oil.

8. The process described in claim 6 wherein said zeolite has a silica to alumina ratio of at least about 12 and a Constraint Index of 1 to 12.

9. The process described in claim 6 wherein said zeolite is ZSM-5 or ZSM-11.

10. The process described in claim 6 wherein said particle size is from less than about 0.01 microns to about 5 microns.

11. The process described in claim 6 wherein said zeolite is hydrogen mordenite.

12. The process described in claim 6 wherein said zeolite is hydrogen Y or rare earth exchanged hydrogen Y.

13. The process described in claim 6 wherein said waxy oil is a whole virgin crude oil.

14. The process described in claim 6 wherein said waxy oil is a petroleum distillate fraction.

15. A reactive dispersion comprising a convertible hydrocarbon oil having dispersed therein from about 0.02 wt.% to about 10 wt.% of said oil of particles comprising a catalytically active zeolite that sorbs normal hexane, said particles having a particle size from less than about 0.01 micron to 250 microns.

16. The reactive dispersion described in claim 15 wherein said convertible hydrocarbon oil is selected from the group consisting of a waxy hydrocarbon oil boiling above 350° F. and a viscous hydrocarbon oil boiling above 350° F.

17. The reactive dispersion described in claim 15 wherein said particles comprising zeolite consist of synthetic zeolite crystals having a particle size from less than about 0.01 to about 5 microns.

18. The reactive dispersion described in claim 15 wherein said zeolite is hydrogen Y.

19. The reactive dispersion described in claim 15 wherein said zeolite is hydrogen mordenite.

20. The reactive dispersion described in claim 15 wherein said zeolite has a silica to alumina ratio of at least about 12 and a Constraint Index of about 1 to about 12.

21. The reactive dispersion described in claim 20 wherein said zeolite is ZSM-5.

22. A paraffin-base virgin crude oil containing an amount of particulate solid comprising a crystalline zeolite having a silica to alumina ratio of at least about 12 and a Constraint Index of from about 1 to about 12, said amount being less than 2 wt.% of said crude oil and effective to dewax said crude oil on heating at elevated temperature.

23. The process described in claim 6 wherein said convertible hydrocarbon oil is shale oil.

* * * * *

UNITED STATES PATENT AND TRADEMARK OFFICE

CERTIFICATE OF CORRECTION

PATENT NO. : 4,263,126

DATED : April 21, 1981

INVENTOR(S) : Louis Deane Rollmann

It is certified that error appears in the above-identified patent and that said Letters Patent are hereby corrected as shown below:

| | |
|---|---|
| Col. 6, line 2 | "to" should be --and-- |
| Col. 6, line 54 | "beconverted" should be --be converted-- |
| Col. 7, line 61 | "used" should be --use-- |
| Col. 8, line 66 | "partilces" should be --particles-- |
| Col. 11, line 4 | "-130°C." should be -- -13°C.-- |
| Col. 11, line 37 | Delete the second "from" |

Signed and Sealed this

*Eleventh* Day of *August 1981*

[SEAL]

*Attest:*

GERALD J. MOSSINGHOFF

*Attesting Officer*

*Commissioner of Patents and Trademarks*